US007455810B2

(12) United States Patent
Fontana et al.

(10) Patent No.: US 7,455,810 B2
(45) Date of Patent: Nov. 25, 2008

(54) METALLURGICAL REACTOR FOR THE PRODUCTION OF CAST IRON

(75) Inventors: Piergiorgio Fontana, Genoa (IT); Giovanni De Marchi, Genoa (IT); Alessandro Molinari, Riomaggiore (IT)

(73) Assignee: SMS DEMAG S.p.A. (IT)

( * ) Notice: Subject to any disclaimer, the term of this patent is extended or adjusted under 35 U.S.C. 154(b) by 496 days.

(21) Appl. No.: 10/844,362

(22) Filed: May 13, 2004

(65) Prior Publication Data

US 2004/0227279 A1 Nov. 18, 2004

(30) Foreign Application Priority Data

May 14, 2003 (IT) ..... GE2003A0033

(51) Int. Cl.
*C21B 13/04* (2006.01)

(52) U.S. Cl. ..... 266/225; 266/241

(58) Field of Classification Search ..... 266/216, 266/267, 225, 241
See application file for complete search history.

(56) References Cited

U.S. PATENT DOCUMENTS

| | | | | |
|---|---|---|---|---|
| 4,243,351 A | | 1/1981 | Legille et al. | |
| 4,913,734 A | | 4/1990 | Romenets et al. | |
| 5,366,537 A | * | 11/1994 | Schlichting | 266/225 |
| 5,890,889 A | * | 4/1999 | Barstow | 266/197 |
| 6,368,548 B1 | | 4/2002 | Innes | |

FOREIGN PATENT DOCUMENTS

| | | |
|---|---|---|
| DE | 719 137 | 3/1942 |
| DE | 25 50 761 | 6/1976 |
| DE | 101 14 720 | 9/2002 |
| EP | 0 021 487 | 1/1981 |
| EP | 0 429 978 | 6/1991 |
| EP | 0 200 996 | 11/1994 |
| GB | 1474357 | * 5/1977 |
| WO | WO 00/73515 | 12/2000 |

OTHER PUBLICATIONS

Patent Abst. Of JP. vol. 006, No. 158 (C-120); Aug. 19, 1982; Kobe Steel Ltd.

* cited by examiner

*Primary Examiner*—Scott Kastler
(74) *Attorney, Agent, or Firm*—Stites & Harbison PLLC; Marvin Petry

(57) ABSTRACT

Metallurgical reactor for the production of cast iron, consisting of a metal casing internally lined, at least partially, with refractory material and provided, in the region of the top closure, with a duct through which high-temperature ferrous material is introduced, said reactor being equipped with a first series of lances for injecting the comburent gas, which are suitably directed and arranged on at least a first bottom level situated in the vicinity of the crucible for collecting the cast iron and through which, in association with a comburent gas, coal of suitable grain size is blown by means of a suitable carrier gas. Said duct has suitable cooling means and is provided, in the bottom terminal part, with nozzles for blowing in compressed gas. The middle zone of the casing of the reactor is lined internally with refractory material, pockets for receiving plates made of metal which is a good heat conductor being formed in said lining, said plates being provided on their side directed towards the outside of the reactor with heat exchanger means for cooling thereof.

17 Claims, 5 Drawing Sheets

METALLURGICAL REACTOR FOR THE PRODUCTION OF CAST IRON

BACKGROUND AND SUMMARY OF THE INVENTION

The present invention relates to metallurgical reactors, and more particularly so-called "smelter" metallurgical reactors suitably for carrying out a cast iron production process forming part of the group of processes known as "smelting reduction" processes. According to this group of processes, the cast iron is produced from: a material containing iron, for example iron ore and/or other reducible metal oxides such as manganese, nickel, chromium, etc., where applicable pre-heated and/or pre-reduced; a carbon-based reducing material, for example coal; a comburent gas containing oxygen, for example industrial oxygen. The products of the process are: liquid cast iron composed of an alloy of iron and other metals with a high concentration of carbon in solution form; the liquid slag, mainly composed of calcium, silicon, magnesium and aluminium oxides, and a gas containing sizeable fractions of carbon monoxide and carbon dioxide resulting from the reduction and combustion reactions.

The reactor according to the present invention is essentially composed of a metal casing internally lined, at least partially, with refractory material and provided, in the region of the top closure, with a duct through which the material containing iron or other reducible materials, for example iron ore, previously heated to a high temperature and partially reduced in a solid-state direct reduction reaction, for example a rotating-hearth furnace, is introduced.

In this metallurgical reactor it is required to perform efficient cooling of the ore supply duct both to protect it from the high temperatures and the damage resulting therefrom and to prevent adhesion, inside and outside thereof, of semi-molten materials and slag which would prevent the descent of the materials and would negatively affect regular execution of the process. The solution used in order to perform said cooling, which is known as "water jacket", consists in surrounding this duct with a cavity inside which a cooling fluid flows. This solution may be regarded as being adopted from other metallurgical applications which are characterized by similar environmental conditions (for example oxygen lances for steel plant converters) where this problem is commonly solved by cooling, usually with water, the product which enters into the reactor.

One of the main problems in these reactors is that of ensuring both the regular descent of the charge material into the underlying slag bath and the elimination or reduction to a minimum of the material lost as a result of entrainment by the gases flowing out from the reactor.

In accordance with a main characteristic feature of the present invention, this problem is solved by providing, in the bottom terminal part of the said material loading duct, a series of nozzles for blowing in compressed gas, for example air, steam or nitrogen, in order to create a descending gaseous curtain around the charge material outflow opening, which assists regular descent of the said material, facilitating its introduction into the underlying liquid slag bath. Moreover, owing to the presence of these gaseous jets, in the vicinity of the outflow opening of the duct a dynamic vacuum is created, this vacuum counteracting any tendency of the process gas to rise back up through the duct during pressure transient peaks of the reactor due to the natural fluctuations in the process.

In accordance with a further feature of the present invention, the axis of the terminal part of the said material loading duct is advantageously inclined with respect to the vertical in the direction of the walls of the reactor and means are provided in order to rotate said duct part about a vertical axis so as to distribute the ferrous material the whole way around the chamber of the reactor, so as to prevent accumulation thereof in the central zone where there is greater turbulence, favouring at the same time introduction thereof into the underlying liquid slag bath.

The reduction smelting reactors of the type according to the invention are generally equipped with means for the injection of comburent gas, in some cases performed with lances which are suitably directed and arranged on at least two levels. In the reactor according to the present invention, via the lances positioned at a lower level (reducing zone), namely at the level of the reactor crucible, or via suitable lances positioned in the vicinity thereof, coal of suitable grain size is blown into the mass of molten cast iron by means of a suitable carrier gas.

The side walls and the bottom of the reactor are lined with refractory material suitable for containing the liquid phases of the process. To ensure efficiency of the process, an intense circulation of the liquid slag is required between the upper zone or oxidising zone and the bottom zone or reducing zone. This circulation obviously involves a high degree of heat exchange as a result of convection between the slag and the refractory lining which contains it. This, combined with the chemical aggressiveness of the liquid slag with respect to any refractory material with which it comes into contact, is a factor which greatly influences the duration of the refractory lining and, basically, in most of the already known smelting reduction processes is the main unresolved problem preventing commercialisation thereof.

In accordance with a further characteristic feature of the present invention, in order to overcome this problem, cooling elements are arranged in the wall section situated opposite the slag bath and the slag bath/cast iron transition zone, said elements being intended to remove the heat from the bath with an intensity such as to cause solidification of the slag and therefore prevent erosion of the refractory material, to a depth of penetration of said erosion, known as "freeze line", of acceptable magnitude, namely sufficient for ensuring the structural stability of the remaining wall.

Advantageously, these cooling elements consist of plates made of metal with a high thermal conductivity, for example copper, formed preferably from a laminate in order to take advantage of the optimum mechanical properties and the improved thermal conductivity, compared to copper produced by means of casting, and consisting of solid metal on the inside of the casing and having formed in them channels through which the cooling fluid passes on the outside of the casing. The dimensions of these elements have been optimised in order to achieve various objectives: sufficient removal of heat in the specific slag turbulence conditions required by the process; keeping the temperature of the metal (copper) below the critical value for the long-term stability of its metallurgical properties; sufficient mechanical strength for interacting, without causing damage, with the surrounding refractory material during each operating stage, including the transient phases; easy replacement without the need to empty the reactor; suitable configuration for keeping the refractory material in position even when partly worn; lower weight (and consequently cost) per unit of surface area of the cooled wall; easy mechanical machining.

The top part of the reactor, above the liquid bath, is surrounded by cooled refractory or metallic walls and is closed at the top by a cooled metallic or refractory cover having formed in it an opening for outflow of the gases produced by the process and destined for processing and purification plants.

The gas thus produced, which still contains a sizeable fraction of carbon monoxide, may be used, for example, as fuel in the pre-reduction rotating-hearth furnace.

BRIEF DESCRIPTION OF THE DRAWINGS

Further objects and advantages of the present invention will be understood more clearly during reading of the following description considered by way of a non-limiting example with reference to the accompanying drawings in which.

DESCRIPTION OF THE PREFERRED EMBODIMENTS OF THE INVENTION

Figure 1:
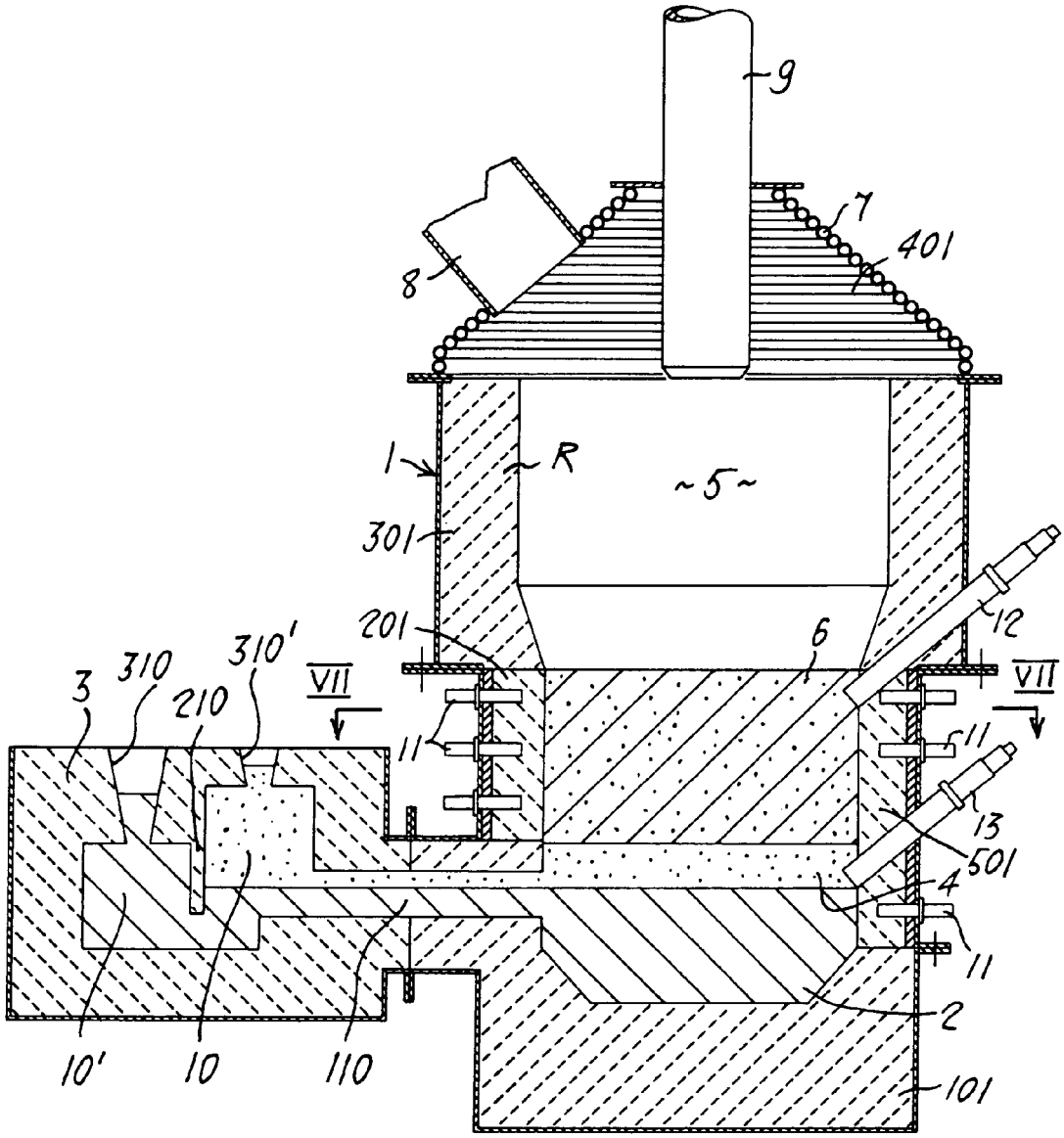
FIG. 1 is a side elevation and sectioned view of a metallurgical reactor for the production of cast iron according to the present invention, provided centrally with a duct for supplying iron ore.

With reference to the accompanying figures and in particular to FIG. 1 thereof, 1 denotes the metal casing of the reactor, having an approximately cylindrical shape. This casing 1 is lined internally at least partially with a refractory material R suitable for containing the reacting materials. In the reactor shown it is possible to distinguish three zones containing liquid with a density decreasing from the bottom upwards, namely the liquid cast iron bath 2 contained in the crucible 101, the transition zone 4 for the cast iron 2 and the actual slag 6, both contained inside an approximately cylindrical casing. The reactor wall has, formed therein, level with said transition layer 4 a hole 110 communicating with an external "calming" well 3 which allows settling of the two phases 2 and 4 and separation from each other as a result of overflow, by means of a suitable diaphragm 210 consisting of two different sections 10, 10' of the said well, for extraction said phases from the reactor. In the example shown, said extraction occurs continuously, on the basis of the principle of "communicating vessels" following overspill of the two liquid phases 2 and 4 from suitable overflow openings 310, 310' in the walls of the well 3. The system thus devised is self-regulating both as regards maintaining the overall level of the molten phase in the reactor and as regards the relative proportion of the two phases 2 and 4. In fact, a variation in the overall level of the two phases inside the reactor, according to the principle of communicating vessels, is produced by a greater proportional overspill from the well 3 with a consequent greater throughput of liquid extracted from the reactor which brings back the level to the desired value. An increase in the relative proportion of one of the two liquid phases inside the reactor produces a corresponding vertical displacement of the "transition zone" 4 in such a way as to favour the outflow of a richer liquid of the phase which is prevalent in that moment, thus readjusting the relative proportion of the two phases to the desired value. A layer essentially consisting of the slag phase 6 is situated above the zone of transition between the two liquid phases.

12 and 13 denote lances for injecting a comburent gas (lance 12) or a gas in combination with particles of coal (lance 13). The introduction, via the lance 13, of a comburent gas and carbon, together with the associated carrier gas, produces an intense turbulence at the interface between the two liquid phases, resulting in a zone of intense mixing of the slag with droplets of cast iron and particles of carbon. This zone is the site where most of the reduction processes occur. Part of the heat required for these (endothermic) reactions to take place is provided by the combustion of the carbon with the oxygen injected into the same zone. Since the reactions for reduction of the metal oxides must take place in this zone, the only product from combustion of the carbon which is thermodynamically stable is carbon monoxide. From an energy point of view, it is known that that combustion of carbon with CO releases a much smaller amount of energy than carbon with $CO_2$. Consequently, with this sole combustion product, the amount of carbon which must be used in order to sustain the process in terms of energy would be very high. For this reason the lances 12 are provided at a higher level, said lances having the function of completing the combustion by converting at least part of the CO into $CO_2$ with the corresponding release of energy. In this so-called "oxidising" zone, the reduction reactions do not take place. The presence of the slag 4 between the two zones creates an isolating layer which is sufficient for the two (reducing and oxidising) environments to coexist with the minimum amount of interference. On the other hand, in order for the heat released in the oxidising zone to be used efficiently it must be transported into the reducing zone without dispersion elsewhere, for example in the outgoing gases and without producing local overheating, which would be damaging for the life of the reactor. This objective may be achieved both by ensuring there is an intense circulation within the slag phase, which circulation is activated by the introduction of comburent gas at a high pressure from both the lance levels 12 and 13, and by directing said lances downwards, so as to induce the necessary circulation of the slag. Said turbulence, moreover, favours the incorporation of the ferrous charge into the liquid bath and its rapid liquefaction.

In order to counteract the negative effect of the abovementioned turbulence on the duration of the refractory lining, in the region of both the slag-metal transition zone 4 and the slag zone 6, a series of cooling plates 11 made of metal having a high thermal conductivity are provided, being suitably mounted in the refractory lining itself, as described below.

Figure 7:
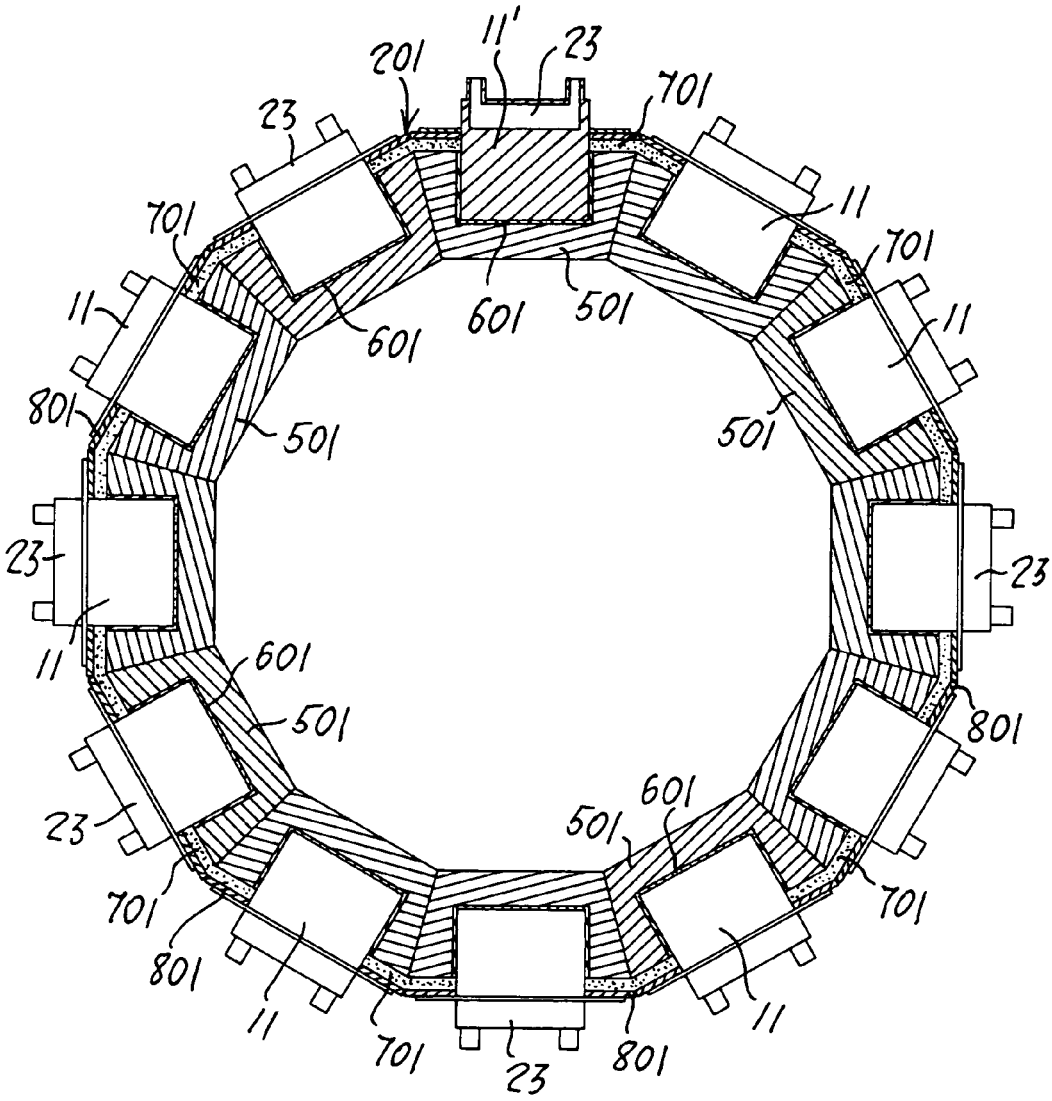
FIG. 7 shows a plan view of the metallurgical reactor according to FIG. 1, sectioned along the line VII-VII in FIG. 1.

FIG. 7 shows a cross-sectional plan view, along the line VII-VII of FIG. 1, of the middle zone 201 of the reactor 1. This cylindrical middle zone 201 is lined with a series of blocks 501 of refractory material suitable for containing the liquid phases of the process. As mentioned, the efficiency of the process requires an intense circulation of the liquid slag between the upper oxidising zone and the bottom reducing zone. This circulation obviously implies a high thermal exchange between the slag and the refractory lining which contains it. This, together with the chemical aggressiveness of the liquid slag with respect to any refractory material with which it makes contact, greatly influences the duration of the refractory lining and, basically, in most of the already known smelting reduction processes, constitutes the main unresolved problem preventing these processes from being commercialised. In order to overcome this problem, in the reactor according to the present invention, the wall section situated opposite the slag bath and the slag bath/cast iron transition zone is provided with cooling elements 11 intended to remove the heat from the bath with an intensity such as to cause solidification of the slag and therefore stop erosion of the refractory material, to a depth of penetration of said erosion, known as "freeze line", of acceptable magnitude, namely sufficient for ensuring the structural stability of the remaining wall.

These cooling elements consist of plates made of metal with a high thermal conductivity 11, for example plates of copper, formed preferably from a laminate and consisting of solid metal on the inside of the casing and having formed in them channels 23 through which the cooling fluid, for example water, passes on the outside of the casing. The design of these elements has been optimised in order to achieve various objectives: sufficient removal of heat in the specific slag turbulence conditions required by the process; keeping the temperature of the metal (copper) below the critical value for the long-term stability of its metallurgical properties; sufficient mechanical strength for interacting, without causing damage, with the surrounding refractory material during each operating stage, including the transient phases; total safety as regards accidental leaks of coolant; easy replacement without the need to empty the reactor; suitable configuration for keeping the refractory material in position even when partly worn; lower weight (and consequently cost) per unit of surface area of the cooled wall; easy mechanical machining.

Said plates 11 are advantageously housed inside pockets formed in the refractory wall 501. A refractory paste with a high thermal conductivity is arranged in the free space between said plates and said wall, said paste forming a layer 601 able to ensure firm contact and consequent optimum transmission of the heat between plate and wall. A layer 701 of insulating material, which protects said metal casing from excessively high temperatures, is arranged between the wall 501 and the outer metal casing 801.

These plates 11, see for example the cross-section of the plate 11', each have a part which protrudes from the metal casing of the reactor and inside which the pipe 23 for circulation of a coolant is inserted, usually water. This system allows: removal, from the bath, of a very high specific thermal flow without damaging the actual plates and the refractory material; maintenance of the thermal flow exchanged between water and plate well below the critical value at which boiling starts; prevention of any risk of accidental spillage of water inside the reactor, even in the case of damage of the plate part which is most exposed to the stresses causes by the process, owing to the fact that the water flow pipe 23 is kept outside the casing 1 of the reactor; easy inspection and replacement of the plates 11; where necessary, sliding of the plates 11 in keeping with any thermal expansion of the wall, ensuring good contact between plate 11 and refractory material.

The free space 5 of the internal volume of the reactor above the liquid bath forms a zone for "freeing" the gas produced by the process from the carbon dust and droplets, allowing the discharging thereof from the reactor with reduced loads of suspended material. In this zone, the thermo-chemical stresses on the internal lining are less than those of the liquid zones. Therefore the side walls and the vault of said zone may be designed using conventional techniques such as direct "water screen" cooling on the outside of the casing or indirect cooling by means of a "membraned wall" (consisting of steel water-cooling pipes welded together so as to form a continuous wall). In the example shown, the side walls of this zone are lined with a uniform layer of refractory material R, while the cover 401 is made using the technique of a membraned wall. This cover has, extending from it, a chimney 8 for removal of the exhaust fumes destined for plants for further processing and a duct 9 which is positioned centrally and from which the iron ore is fed into the reactor.

Figure 2:
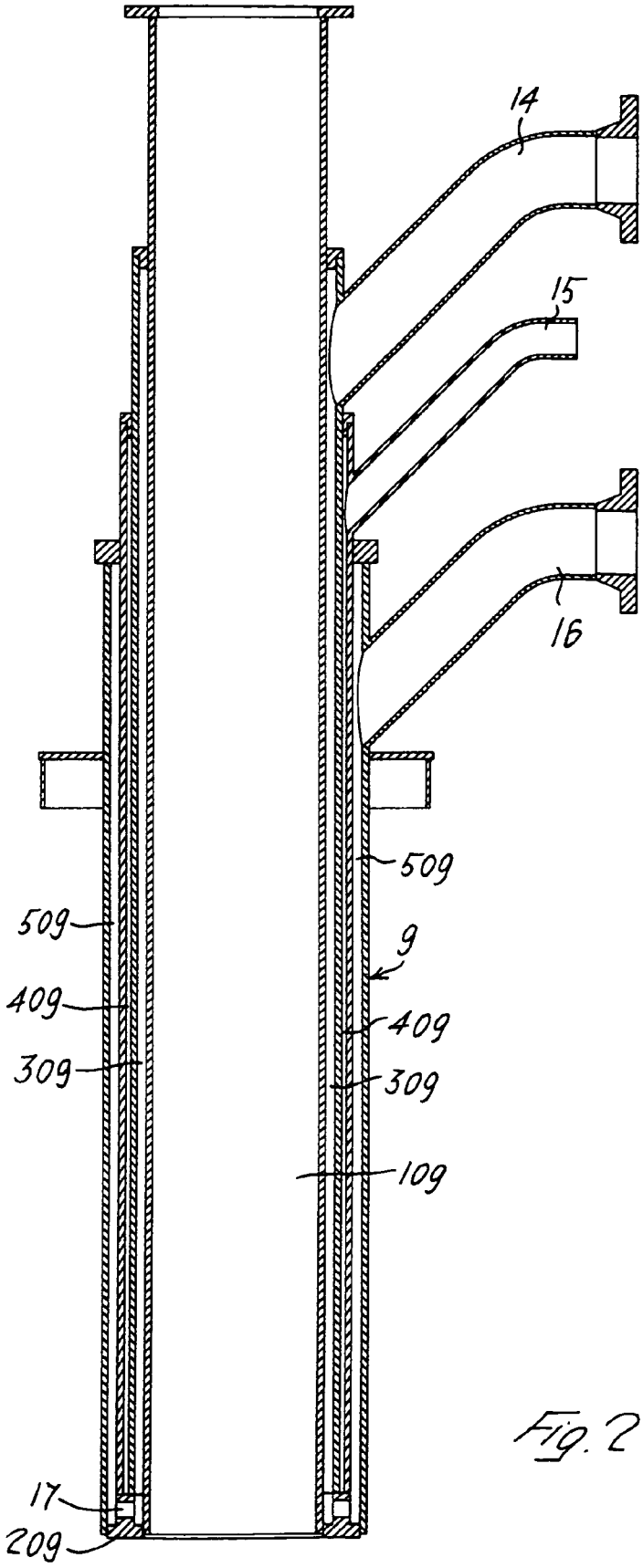
FIG. 2 shows a side elevation and sectioned view of the supply duct according to FIG. 1.

FIG. 2 shows a cross-section through a portion of the duct 9 for feeding iron ore into the reactor. This duct 9 comprises: a central channel 109 for supplying said ore; a first outer jacket 309 coaxial with said central duct 109 and connected to a pipe 14 for supplying a cooling fluid (usually water); a second outer jacket 409 coaxial with said first jacket 309 and connected to a pipe for blowing in gas under pressure, for example, air, steam or nitrogen; a third outer jacket 509 coaxial with said second jacket 409 and connected to a pipe 16 for discharging the cooling fluid, and a bottom annular end-piece 209, for closing off the various jackets 309, 409, 509 for the purposes described below. The cooling fluid has the function of both protecting the duct 9 from the high temperature and from the damage resulting therefrom and of preventing adhesion, on the inside and outside thereof, of semi-molten material and slag which would prevent descent of the material and negatively affect regular execution of the process.

Figure 3:
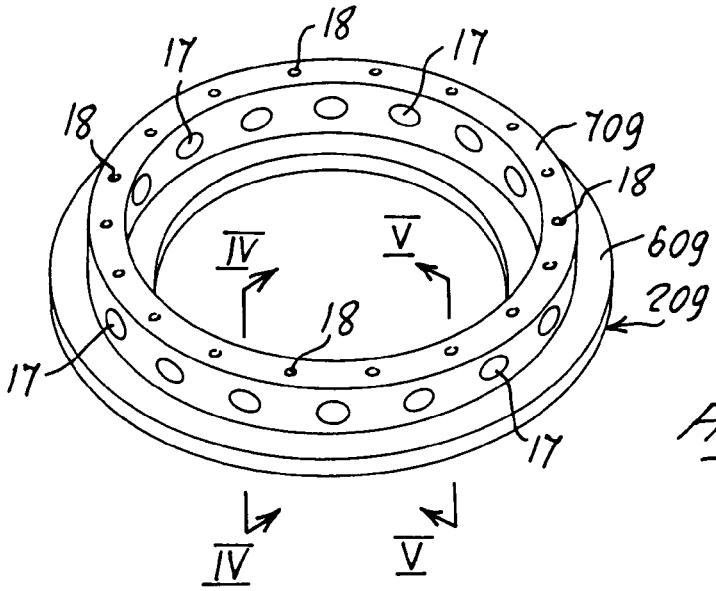
FIG. 3 shows a perspective view of an annular end-piece fixed to the bottom end of the supply duct according to FIG. 2.

With reference to FIG. 3, this shows the annular end-piece 209 which is fixed to the bottom end of said duct 9. This annular end-piece 209 has a bottom flange 609 on which a sleeve 709 is integrally formed, said sleeve having along the whole of its circular perimeter a series of radial through-holes 17 which are formed transversely with respect to the associated side wall and which connects together the cavities 309 and 509 for circulation of the cooling fluid, and a series of vertical holes or nozzles 18 communicating with the cavity 409 for blowing in the compressed gas. These through-holes 17 are arranged at a certain distance from each other and a nozzle 18 is provided between each pair of said horizontal through-holes 17.

The purpose of said nozzles 18 is that of creating a gaseous curtain descending around the opening for outflow of the charged material which facilitates the proper descent of the said material, facilitating its introduction into the underlying liquid slag bath and preventing or reducing to a minimum the loss of material as a result entrainment by the gases flowing out from the reactor. The presence of the gaseous jets moreover produces in the vicinity of the outflow opening of the duct a dynamic vacuum which prevents any tendency of the process gases to flow back up through the duct during transient pressure peaks of the reactor due to the normal fluctuations in the process.

Figure 4:
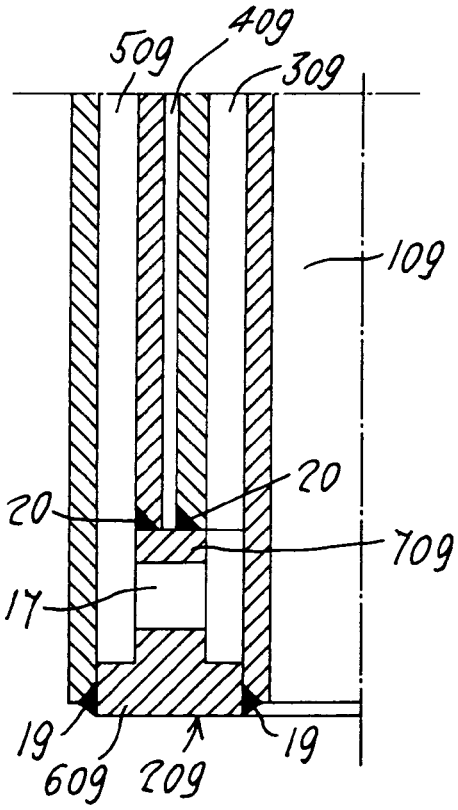
FIG. 4 shows a side elevation and sectioned view of a part of the bottom end of the duct according to FIG. 2, with the associated annular end-piece sectioned along the line IV-IV in FIG. 3.

FIG. 4 shows a cross-section through the duct 9, in the vicinity of the annular end-piece 209 and opposite any one of the horizontal through-holes 17, along the line IV-IV in FIG. 3. In this Figure, it is possible to observe the flow path of the cooling fluid in the duct 9, which, introduced via the corresponding supply pipe 14 shown in FIG. 2, firstly descends along the inner jacket 309, passes through the horizontal through-holes 17 of the annular head 209, rises back up along the outer jacket 509 and finally emerges from the discharge pipe 16 in FIG. 2. The bottom flange 609 of this annular end-piece 209 is fixed by means of welds 19 to the bottom edge of the outer wall of the outer jacket 509 and to the bottom edge of the wall of the central channel 109, while the upper sleeve 709 of said annular end-piece is fixed by means of other welds 20 to the walls of the middle jacket 409.

Figure 5:
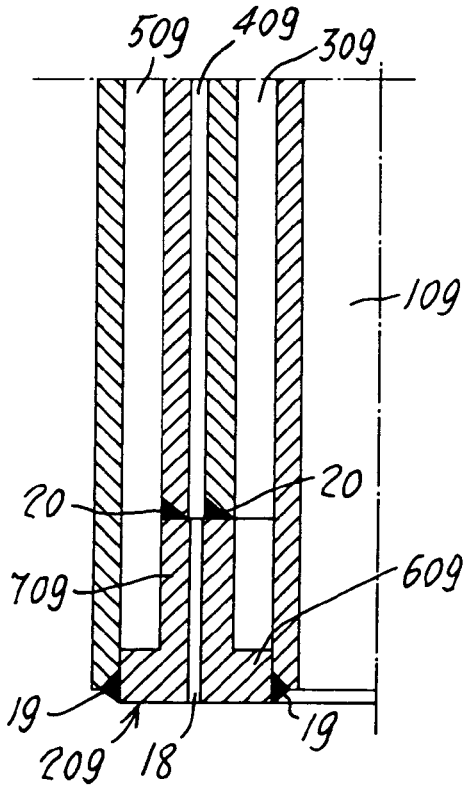
FIG. 5 shows a side elevation and sectioned view of a part of the bottom end of the duct according to FIG. 2, with the associated annular end-piece sectioned along the line V-V in FIG. 3.

FIG. 5 shows another cross-section through the duct 9 in the vicinity of the annular end-piece 209 and opposite any one of the vertical nozzles 18, along the line V-V in *Fig*. 3. The gas under pressure supplied by the associated pipe 15 in FIG. 2 descends along this middle jacket 409 and finally emerges from the annular end-piece 209 of said duct 9 through said nozzles 18.

Figure 6:
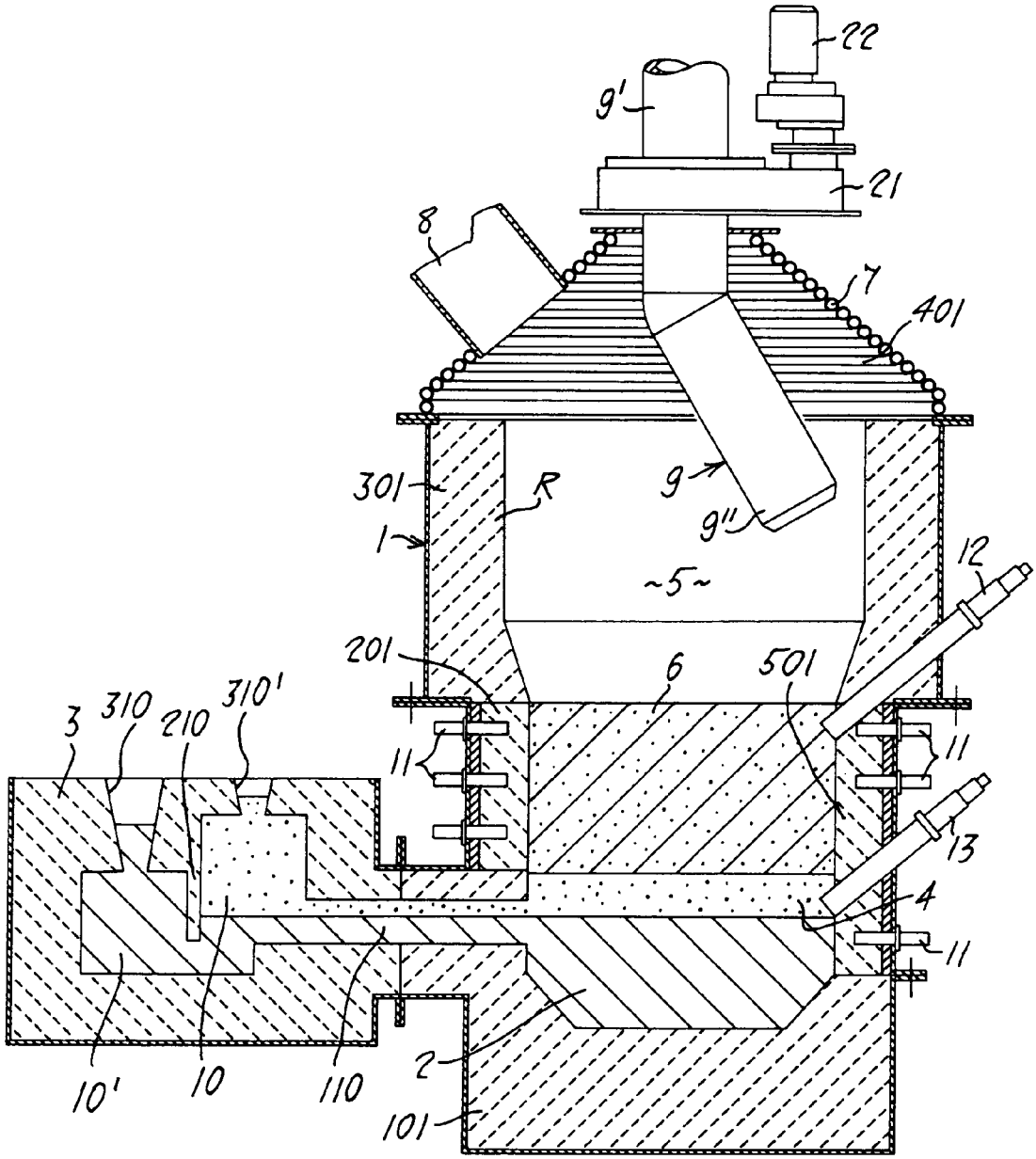
FIG. 6 shows a side elevation and sectioned view of a variant of the present metallurgical reactor for the production of cast iron.

FIG. 6 shows a variant of the metallurgical reactor according to the invention. According to this variant, the duct 9 for supplying pre-reduced hot ore and blowing in gas under pressure is composed of a vertical upper section 91 and a bottom section 9" having a certain inclination with respect to said vertical section 9". Said inclined section 91" is provided at the bottom, in a manner entirely similar to that described above, with the annular end-piece 209 which has horizontal through-holes 17 for circulation of the cooling fluid and nozzles 18 for blowing in the compressed gas, and both said sections 9' and 9" of said duct 9 are provided with the inner jacket 309 and outer jacket 509 for passage of the cooling water and with the middle jacket 409 for blowing in compressed gas. The vertical section 9' of said duct 9 is connected, by means of known transmission means 21, to a motor 22 having the function of causing rotation of said section 9' and therefore also said inclined section 9" integral therewith. Owing to rotation of the supply duct 9, the ore is discharged from the inclined section 9" against the side walls of the reactor, instead of in the central zone; in this way the movement of the liquid slag 6 activated by the lances 12 and 13 favours on the one hand incorporation of the pre-reduced ore in the said slag bath 6 and on the other hand reduces to a minimum the risk of entrainment of fine particles of said ore inside the gas evacuation duct 8 as well as backflow of process gases inside the supply duct 9, since said gases are mainly emitted from the central zone of the reactor. Moreover, the ore which, during rotation of the duct 9, accumulates against the inner walls of the reactor also has a protective function preventing corrosion of the refractory material lining of said walls.

Obviously, the present invention is not limited to the embodiments illustrated and described, but comprises all those variants and embodiments falling within the scope of the inventive idea substantially as claimed below.

Thus, for example, the terminal part of the duct 9, which is made to rotate by the motor 22, as described with reference to FIG. 6 in the drawings, instead of being provided with an inclined duct section 9", is provided with a deflector which is arranged inside it and integral with the duct 9 itself and which deviates the falling trajectory of the ferrous material in the direction of the side wall.

We claim:

1. Metallurgical reactor for the production of cast iron comprising:

a metal casing internally lined with refractory material, said casing having a lower zone which contains molten metal;

a middle zone which contains slag;

an upper zone essentially free from molten metal and slag;

a first series of lances which inject a comburent gas and coal of suitable grain size into the lower zone;

a second series of lances which inject a comburent gas into the middle zone;

a heater for heating ferrous material to a high-temperature; and a duct in the form of a material chute which introduces ferrous material into the upper zone, said duct having an ore outflow opening in a bottom terminal part with said bottom terminal part located to introduce the high-temperature ferrous material into the upper zone by gravitational force, a cooling means for cooling said duct, and nozzles which are located in the bottom terminal part, said nozzles blowing compressed gas into the upper zone.

2. The reactor according to claim 1, in which the compressed gas blown by said nozzles is air, steam, nitrogen, or a mixture thereof.

3. The reactor according to claim 1, in which said nozzles are arranged so that the compressed gas blown therefrom forms a descending gaseous curtain around the ore outflow opening.

4. The reactor according to claim 1, in which said duct comprises a central channel for supplying pre-reduced ore; and an air jacket for blowing in compressed gas to said nozzles, said air jacket being coaxial with said central channel and connected to a pipe for supplying said compressed gas.

5. The reactor according to claim 4, in which said duct comprises at the bottom terminal part an annular end-piece having a series of vertical through-holes aligned with said air jacket for blowing in compressed gas.

6. The reactor according to claim 5, in which said central channel is surrounded by a first cooling jacket coaxial with said central channel; and said air jacket for blowing in compressed gas is surrounded by a second cooling jacket coaxial with said air jacket which blows in compressed gas, said first and second cooling jackets being connected respectively to a pipe which supplies and a pipe which discharges cooling water in any sequence.

7. The reactor according to claim 6, in which said annular end-piece comprises a bottom flange and an upper sleeve which have, formed therein, said vertical through-holes and a series of horizontal through-holes for passage of the cooling water from said first cooling jacket to said second cooling jacket or vice versa, and in which said upper sleeve said horizontal through-holes alternate with said vertical through-holes and said bottom flange are passed through by said vertical through-holes.

8. The reactor according to claim 1, in which said duct is provided with:

a first vertical upper section and a second bottom section which is inclined with respect to said first upper section and which projects inside said upper zone of the casing, said second bottom section being arranged to deviate falling of the ferrous material in the first vertical upper section towards a side wall of the upper zone; and in which said duct is made to rotate by a motor connected by a transmission to said first vertical upper section.

9. The reactor according to claim 1, in which the bottom terminal part of the vertical duct is made to rotate by a motor connected thereto by transmission, said bottom terminal part being provided with a deflector arranged therein and integral with said duct and which said deflector deviates a falling trajectory of the ferrous material in the direction of a side wall of the upper zone.

10. The reactor according to claim 1 wherein said middle zone of the casing is lined internally with a wall of refractory material, pockets which receive plates made of metal which is a good heat conductor are formed in said wall, and said plates are provided on a side thereof directed towards an outside of the casing with a heat exchanger means for cooling thereof.

11. The reactor according to claim 10, in which said wall comprises pre-formed refractory blocks.

12. The reactor according to claim 10, in which said plates are copper plates.

13. The reactor according to claim 12, in which said copper plates are composed of copper laminate.

14. The reactor according to claims 12, in which each of said copper cooling plates comprises at least one pipe for circulating cooling water, positioned outside the casing.

15. The reactor according to claim 14, in which the wall comprises, from the inside towards the outside of the reactor, a refractory wall, a filling layer between the plates and the refractory wall, a layer of insulating material, and an outer metal lining.

16. The reactor according to claim 1, in which said lances are directed downwards to activate the necessary circulation of the slag.

17. The reactor according to claim 1, in which a hole for communication with an external well is formed in the metal casing at a height of a layer where transition occurs between the slag in the middle zone and the metal in the lower zone, said well allowing settling of the two phases and separation from each other by overflow, by means of a suitable diaphragm consisting of two different sections of said well for extracting said phases from the metal casing.

* * * * *